US005640787A

United States Patent [19]

Spademan

[11] Patent Number: 5,640,787

[45] Date of Patent: Jun. 24, 1997

[54] ANKLE TIGHTENING AND FLEXION LIMITING DEVICE

[76] Inventor: Richard G. Spademan, 2600 Capitol Ave. #414, Sacramento, Calif. 95816

[21] Appl. No.: 417,299

[22] Filed: Apr. 5, 1995

Related U.S. Application Data

[63] Continuation-in-part of Ser. No. 197,221, Feb. 16, 1994, Pat. No. 5,426,871, which is a continuation-in-part of Ser. No. 902,781, Jun. 23, 1992, abandoned, which is a continuation-in-part of Ser. No. 629,044, Dec. 14, 1990, abandoned, which is a continuation-in-part of Ser. No. 129,141, Dec. 7, 1987, Pat. No. 4,949,326, which is a continuation-in-part of Ser. No. 751,828, Jul. 5, 1985, abandoned, which is a continuation-in-part of Ser. No. 50,436, Jun. 20, 1979, Pat. No. 4,494,324, which is a continuation-in-part of Ser. No. 886,946, Mar. 15, 1978, Pat. No. 4,382,342.

[51] Int. Cl.[6] ..... A43B 5/04

[52] U.S. Cl. ..... 36/117.3; 36/118.2; 36/118.8

[58] Field of Search ..... 36/2.5, 1.5, 54, 36/81, 88, 89, 93, 109, 117–121

[56] References Cited

U.S. PATENT DOCUMENTS

| | | |
|---|---|---|
| 3,475,835 | 11/1969 | Kovar . |
| 3,713,231 | 1/1973 | Mochizuki . |
| 3,722,112 | 3/1973 | Morgan . |
| 3,828,448 | 8/1974 | Leonildo . |
| 3,855,716 | 12/1974 | Hutchinson . |
| 3,922,800 | 12/1975 | Miller et al. . |
| 3,988,842 | 11/1976 | Rathmell . |
| 4,021,053 | 5/1977 | Willi . |
| 4,160,332 | 7/1979 | Salomon . |
| 4,196,530 | 4/1980 | Delery . |
| 4,406,073 | 9/1983 | Spademan . |
| 4,420,893 | 12/1983 | Stephan . |
| 4,426,796 | 1/1984 | Spademan . |
| 4,447,968 | 5/1984 | Spademan . |
| 4,455,768 | 6/1984 | Saloman . |
| 4,494,324 | 1/1985 | Spademan . |
| 4,523,395 | 6/1985 | Borsoi . |
| 4,534,122 | 8/1985 | MacPhail . |
| 4,677,769 | 7/1987 | Ahmad et al. . |
| 4,928,405 | 5/1990 | Spademan . |
| 5,426,871 | 6/1995 | Spademan et al. ..... 36/120 |

FOREIGN PATENT DOCUMENTS

| | | |
|---|---|---|
| 0 145 704 | 11/1984 | European Pat. Off. . |
| 70.13712 | of 1970 | France . |
| 2496423 | 12/1980 | France . |
| 2 544 969 | 4/1983 | France . |
| 2321817 | 11/1973 | Germany . |
| 29 53 208 | 9/1980 | Germany . |
| 484 643 | 3/1970 | Switzerland . |
| 506261 | 6/1971 | Switzerland . |
| WO 80/02789 | 12/1980 | WIPO . |
| WO 92/19117 | 11/1992 | WIPO . |

*Primary Examiner*—Ted Kavanaugh
*Attorney, Agent, or Firm*—Townsend and Townsend and Crew LLP

[57] ABSTRACT

A sport shoe device which prevents dorsiflexion or plantar flexion of the ankle past a predetermined optimum angle, while permitting tightening on the instep during further flexion of the leg relative to a ski boot contact surface. The device is preferably used with a ski boot including a sole, a shell defining a foot section connected to the sole and cuffs defining a leg section connected to the shell for forward and rearward movement of the cuffs relative to the shell. Overlying the sole is a movable footbed. The footbed is operatively connected to the shell, cuffs and instep strap by a yoke and cable or spring. Movement of the leg and cuffs relative to the foot and footbed beyond a predetermined angle pivots the footbed, tightening the instep strap on the instep while maintaining the predetermined flexion angle during further flexion.

18 Claims, 2 Drawing Sheets

ANKLE TIGHTENING AND FLEXION LIMITING DEVICE

This is a continuation-in-part application of U.S. patent application Ser. No. 08/197,221 filed Feb. 16, 1994 now U.S. Pat. No. 5,426,871 which was a continuation in part of patent application Ser. No. 07/902,781 filed Jun. 23, 1992 now abandoned which was a continuation in part of patent application Ser. No. 07/629,044 filed Dec. 14, 1990 now abandoned which was a continuation in part of patent application Ser. No. 129,141 filed Dec. 7, 1987, now U.S. Pat. No. 4,949,326 which was a continuation in part of patent application Ser. No. 06/751,828 filed Jul. 5, 1985 now abandoned which was a continuation in part of patent application Ser. No. 50,436 filed Jun. 20, 1979 now U.S. Pat. No. 4,494,324, which was a continuation-in-part of U.S. patent application Ser. No. 886,946 filed Mar. 15, 1978 now U.S. Pat. No. 4,382,342.

BACKGROUND OF THE INVENTION

The present invention relates to a sport shoe device, particularly incorporated in a ski boot, which prevents or at least minimizes dorsiflexion or plantar flexion of a user's foot relative to the user's leg beyond a predetermined optimum angle while permitting further forward or rearward flexion of the leg relative to the ski boot and ski surface interface and which increases the tightness of the shoe on the foot during this further flexion. The invention is particularly well suited for use while skiing in downhill ski boots but is also usable for other sport shoes where limiting dorsiflexion to some optimum angle and adjusting the tightness of the fit during the sport performance is desired.

A sport shoe forms the connection between an athlete and the surface on which he or she performs, such as the ski and downhill slope or cross country for skiing, the playing field for such sports as soccer, football or tennis, or the road or path along which a runner runs. Major maneuvers of the athlete require the transmission of forces between the runner's leg and the ground via the sport shoe. These maneuvers are accompanied by conscious immovement or movement of the athlete's ankle, that is, muscular activity to immobilize or mobilize the foot relative to the leg. Compared to other major body joints there is weak muscular control and limited range of motion of the foot in dorsiflexion or plantar flexion.

To enable the sport shoe to efficiently transmit often significant forces, the sport shoe must provide the proper support and tightness for the leg, ankle and foot. At the same time, the sport shoe must be designed so that it allows the athlete to perform all necessary ankle movements and make the most efficient use of his or her muscular strength when performing such movements.

Although this general description of the function of a sport shoe applies to use in virtually all sports, the degree of movement and the magnitude of force to be applied by the lower extremity to execute various maneuvers are particularly evident in downhill skiing.

Of all the sport shoes, downhill ski boots are the most elaborate. Briefly, a downhill ski boot provides an exterior shell for the foot and an exterior cuff or cuffs for the leg which extend well above the ankle. Such boots permit a forward and rearward flexion of the leg with respect to the foot from a preselected "normal" position or dorsiflexion and plantar flexion of the foot relative to the leg, respectively, but they prevent significant medial and lateral or adduction and abduction movements of the foot with respect to the leg, i.e. in all other directions the entire boot is relatively rigid. In the past, this has been accomplished by constructing downhill ski boots of a multi-part, substantially rigid shoe defined by a foot section and a leg section that is typically, movably and usually pivotally attached to the lower foot section. In the interior of the shell is a relatively soft liner. In use, the boot and in particular the sole, which forms part of the lower foot section, is engaged by a binding attached to the ski to thereby rigidly connect the boot to the ski.

While skiing, the boot tightly encompasses the athlete's foot, ankle and leg, typically by means of one or more buckles which tighten the boot against the foot, ankle and the lower leg. Because of the many gross movements and the exertion of large forces during many turning maneuvers executed by a downhill skier, the boot must be relatively tight on the foot, ankle and leg. Frequently, the required tightness is uncomfortable, can reduce blood circulation, and can lead to pain and fatigue. Any looseness of the boot, on the other hand, greatly compromises the athlete's ability to maneuver the skis because of the poor transmission of forces from the leg to the skis.

To overcome this problem, the applicant has previously invented ski boots having dynamic fitting systems disclosed in the above referenced patent applications. Such fitting systems allow a relatively snug and comfortable fit of the boot on the athlete's lower extremity. However, the fit is momentarily tightened in response to relative movement of the leg, typically between his or her foot and leg. Normally, this is accomplished by providing an instep strap, a movable footbed, an adjustable tongue, or the like, which are operatively connected with the lower shell and the upper cuff or cuffs so that upon relative movement between them, the tightness of the fit of the boot increases proportionally to the extent to which an upper cuff or cuffs move relative to the lower shell away from a "normal" position. In ski boots, the "normal" position of an upper cuff typically includes some degree of forward angulation of the upper cuff with respect to the lower shell. Any additional forward or rearward flexion of the lower leg increases the tightness of the fit. Upon return of the upper cuff to its normal position, the tightness of the fit lessens.

Actual tests with such boots have shown that they constitute a remarkable improvement over conventional ski boots which lack a dynamic fitting system. Specifically, discomfort, pain, poor circulation and fatigue which often accompanied prior art ski boots have been substantially eliminated. The tight fit required for executing turning maneuvers and the like during skiing is attained during the turning maneuver. At all other times the fit is less tight and more comfortable.

In spite of the significant improvement provided by the dynamic fitting systems discussed above, sport shoes in general and ski boots fitted with such systems in particular can be improved. Specifically, such dynamic fitting systems affect the tightness of the fit as soon as there is any movement between the lower shell and an upper cuff. This, applicant has discovered, is not always desirable. It is essential that ski boots, for example, provide for an adequate range of motion for the ankle joint in certain skiing conditions and yet tighten by varying amounts on the lower extremity during movement in flexion of the ankle joint and movement of the cuff relative to the shell in these conditions. This range of motion allows the foot and shoe to provide a stable platform when the athlete makes subtle changes in the center of gravity of his or her body. An adequate range of ankle motion is also highly desirable to accommodate the finer muscle movements which take place during certain piloting maneuvers in skiing.

The sport shoe should also enable the athlete to most advantageously utilize his or her maximum muscle strength. Most maneuvers requiring great strength occur in dorsiflexion. In skiing, for example, major changes in direction involve the efficient muscular control of the foot in dorsiflexion for the effective shift in the center of gravity, anticipation, angulation and edging. To obtain the optimum muscular control of the ankle in this posture of dorsiflexion there is a particular position that must be attained and retained from which the various strength related maneuvers can be executed. This position is referred to as the optimum dorsiflexion angle. The existence of an optimum dorsiflexion angle can be traced to certain observed physiological characteristics of muscle and the anatomical orientation of the flexor and extensor muscles of the leg and foot. Among the several characteristics of muscle that must be considered are the following:

(1) muscle mass strength is greatest when the muscle is near its greatest length (Kreighbaum, et al., *Biomechanics, A Qualitative Approach for Studying Human Movement*, Burgess Publishing Co., at pp. 123, 124);

(2) muscle mass strength decreases with increased velocity of contraction (Piscopo and Baley, *Kinesiology, The Science of Movement*, John Wiley & Sons, at pp. 150–151); and (3) muscle mass strength is dependent upon the angle of pull against the boney lever arm (Cooper, et al., *Kinesiology*, The C. V. Mosby Co., at pp. 116–123).

In addition, muscle mass strength is greatest when there is no contraction (Cooper, et al., *Kinesiology*, The C. V. Mosby Co., at p. 109).

Applicant has discovered that optimum strength for skiing maneuvers is attained when the relative angular inclination between the foot and the leg, i.e. dorsiflexion, is approximately 12°. The 12° dorsiflexion angle, however, does not provide proper body balance or positioning of the center of gravity during all phases of skiing. In downhill skiing, when leaving the fall line, often a greater forward flexion of the leg relative to the ski is required than the optimum dorsiflexion angle. This forward flexion is necessary to resist the sideslip of the ski caused by the curved trajectory and pull of gravity. During this drive down the fall line, as the edge angle is increased, the ski becomes more resistant to sideslip, develops an increasing reverse camber and holds better at the tip and tail. The arc of the turn, the rate of movement, and the closeness to the fall line determines the angulation and therefore forward flexion of the leg required to resist the sideslip caused by the centrifugal force. Rearward flexion of the leg relative to the ski is often required in completing certain long radius turns, acceleration at the end of a turn on a steep slope or in slalom racing.

Prior art dynamic fitting systems incorporating a movable footbed maintained a given angularity between the footbed and a cuff. If that angularity is chosen for optimum efficiency, e.g. at 12°, proper balance will not be attained much of the time. On the other hand, if the relative forward angulation of the cuff relative to the footbed is chosen at a lesser value, say between 7° to 9° forward angulation as is typical, optimum strength cannot be attained.

From the foregoing, it is apparent that there is a need for an improved dynamic fitting system which includes a movable footbed and an instep strap that are constructed so as to provide some freedom of motion for the ankle joint without tightening the fit and yet provide the maximum tightness when maximum strength is required. Thus, there is a present need for a dynamic fitting system in which the relative angular inclination and tightness between the foot and the leg is such as to provide comfort for the athlete, and which readjusts the relative angular inclination and tightness of fit during times when maximum strength is required and allows further forward or rearward flexion of the leg relative to the ski boot and ski interface, so as to enable the athlete to exert the greatest possible force at that instance.

SUMMARY OF THE INVENTION

Broadly speaking, the present invention is directed to a device mounted to the user's foot and leg to prevent flexion past a predetermined, optimum angle while performing a sport while adjusting the tightness of the fitting system and permitting further forward or rearward flexion of the leg relative to the sport shoe performing surface. The device finds particular utility when used with, or incorporated into the structure of, a ski boot. The ski boot commonly includes a sole, a shell extending from the sole for receipt of the user's foot, and a movable cuff or cuffs mounted to the shell. The sole, shell and cuffs are constructed so that the user can move his or her foot relatively freely over a limited dorsiflexion or plantar flexion angle. Thereafter, any significant further flexion of the foot relative to the leg is prevented and the tightness of the fit is increased. Flexion, as used in this application, means the backward or forward flexion of the foot or the forward or backward flexion of the leg relative to the foot. Flexion is measured from the position where the leg is perpendicular to the foot.

The sole includes an upper foot supporting surface or footbed and is constructed so that a rearward or heel portion of the upper surface can move upwardly or downwardly while the region of the lower surface of the sole remains flat on the ski.

In one specific embodiment applicant's invention is incorporated in a downhill ski boot having a rigid lower sole, the bottom surface of which is essentially rigidly connected to the ski. A movable, relatively stiff footbed or upper foot supporting surface of the sole overlies the lower sole and is constructed so that at least its heel portion can pivot upwardly or downwardly relative to the lower sole about a pivot point. The pivot point is typically located in the metatarsal phalangeal region, that is the region underlying the ball of the user's foot. The pivotal footbed can be therefore either fully rigid along its entire length or substantially rigid rearwardly of the pivot point. By substantially rigid, it is meant that the footbed has sufficient rigidity to allow lifting of the user's foot in the region behind the ball of the foot.

In a ski boot the cuff or front and rear cuffs are secured to the shell of the ski boot for movement about a pivot or movable axis located near the user's ankle. The pivot points or movable axis of the cuffs and footbed are positioned to maintain the optimum flexion angle of the lower leg and foot. In the interior of the cuff and shell there is an instep strap overlying the liner engaging the instep area of the ankle. Passing over and attached to the instep strap is a cable which is then routed through cable guide loops on the footbed and shell and bores in the rear cuff to an adjustable overcenter buckle located on the rear cuff. The cuffs are coupled to the footbed such that flexion between an initial flexion angle and the optimum angle does not raise the footbed. As a result, the skier can relatively freely move his or her foot between the initial and optimum flexion angle. Rearward or forward flexion of the leg and cuff past the optimum angle adjusts the tightness of the fitting system instep strap and in forward flexion raises the heel portion of the footbed, and in plantar flexion lowers the heel portion of the footbed, thereby minimizing or eliminating flexion movement past the optimum angle because the angularity between the foot and the lower leg remains essentially constant. Further flexion of the leg relative to the sole bottom and thus the ski is possible for further angulation, edging or lowering the center of gravity. These flexion movements cause the ski boot instep strap to tighten as the footbed is raised or lowered. The foot is pressed against the inside of the liner. Yet, the relative angle between the user's foot and lower leg remains in the optimum range.

Other features and advantages of the present invention will appear from the following description in which the preferred embodiment has been set forth in detail in conjunction with the accompanying drawings.

REFERENCE NUMERALS IN DRAWINGS

REFERENCE NUMERALS IN DRAWINGS

Figure 1A:
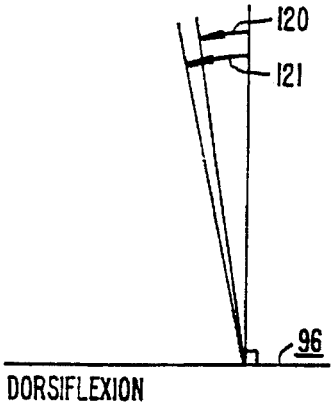
FIGS. 1A and 1B represent the respective foot dorsiflexion angles and leg forward flexion angles accompanying use of the sport shoe of FIG. 1.

| | | | |
|---|---|---|---|
| 66 | boot | 68 | shell |
| 70 | sole | 72 | front cuff |
| 74 | rear cuff | 76 | pivots |
| 78 | adjustable cuff buckle | 80 | cable loop |
| 82 | base | 84 | footbed |
| 86 | liner | 88 | heel |
| 90 | toe | 92 | downwardly extending bar |
| 94 | aperture | 96 | foot support surface |
| 98 | compression spring | 99 | cavity |
| 100 | angle | 101 | guides |
| 102 | lower surface | 104 | yoke |
| 105 | arms | 106 | rivets |
| 108 | portion | 110 | arrow |
| 112 | arrow | 114 | recess |
| 116 | edge | 118 | point |
| 119 | angle | 120 | initial dorsiflexion angle |
| 121 | angle | 123 | lower leg angle |
| 126 | instep strap | 127 | cable |
| 128 | cable guide loops | 129 | cable guide bore |
| 130 | overcenter buckle | | |

DETAILED DESCRIPTION OF THE PREFERRED EMBODIMENTS

Referring now to FIGS. 1 and 1A and 1B and FIG. 2, a preferred embodiment of the invention is disclosed. This embodiment incorporates the dynamic fitting system and dorsiflexion limiting device in the form of a movable instep strap, footbed, cable, cable guide loops and an overcenter buckle mechanism in a sport shoe in the form of a ski boot (66). These devices combine to permit an extended range of flexion for the user's leg relative to the sport performing surface while maintaining optimum flexion coupled with increased boot dynamic tightening during ski maneuvers for greater control. A ski boot (66) includes a shell (68) mounted to a rigid sole (70). The sole is rigidly connected to a ski while performing. Front and rear cuffs (72), (74) are pivotally mounted to shell (68) at pivots (76). (Pivots (76) provide means for permitting flexion of the user's leg relative to the user's foot.) An adjustable cuff buckle (78) engages a cable loop (80) to secure front and rear cuffs (72), (74) about the user's lower leg.

Figure 1B:
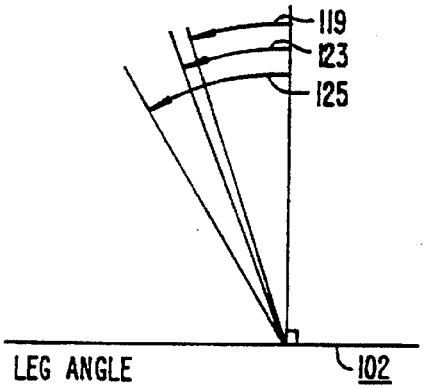
Figure 1:
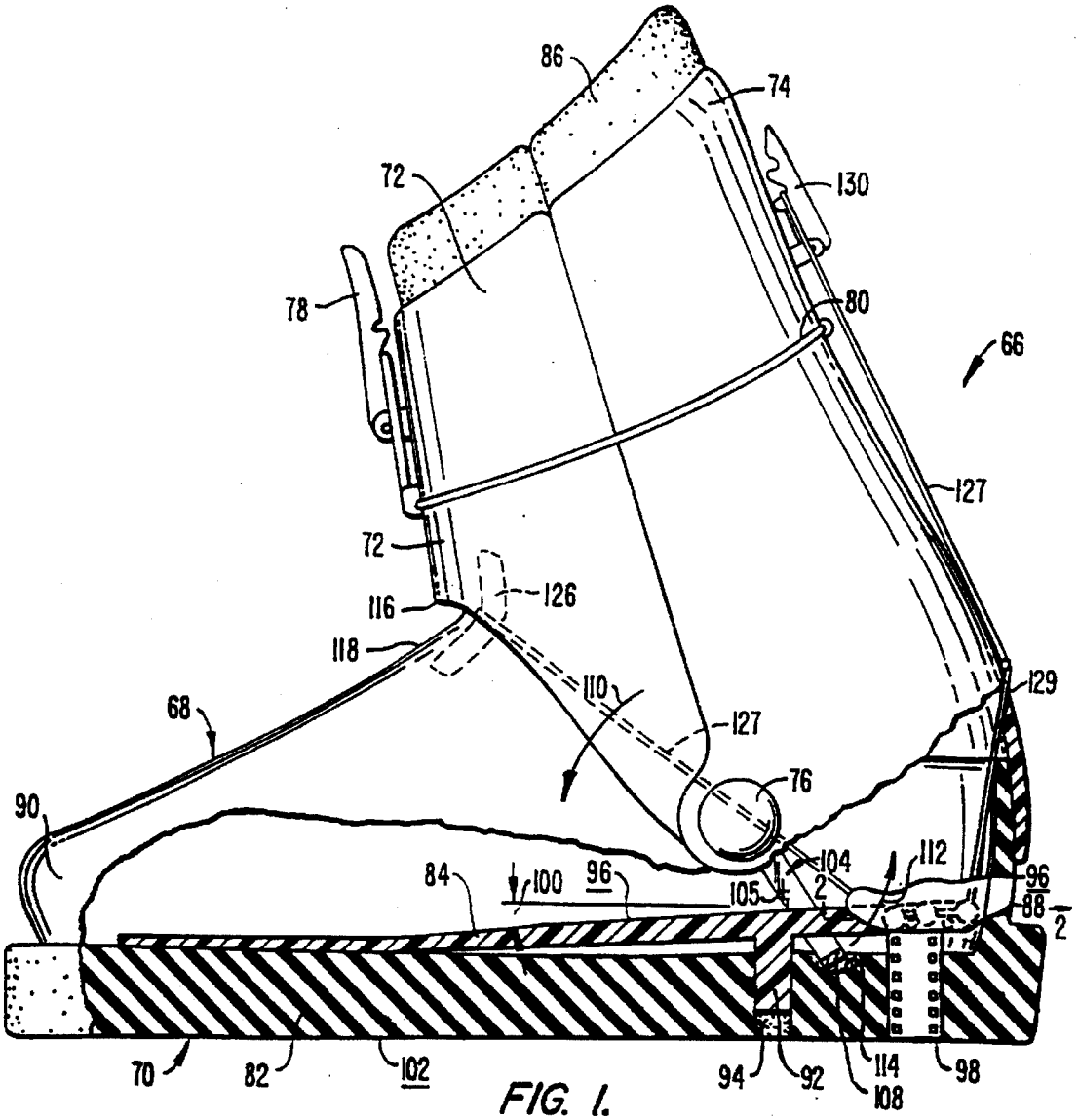
FIG. 1 is a side view of a sport shoe embodiment of the invention showing the instep strap, cable, shell, footbed and cable guide loops at an initial resting position.
Figure 2:
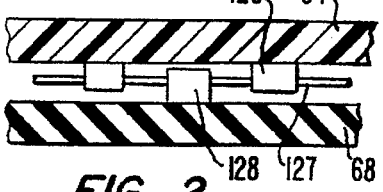
FIGS. 2 is an enlarged top elevational view taken along line A—A of FIG. 1.

Sole (70) includes a rigid base (82) and there is a movable footbed (84) overlying sole (70). The entire boot (66) is lined with a liner (86). However the liner is not shown in the broken out sections for clarity. Footbed (84) extends substantially from the heel (88) to the toe (90) of boot (66) but is not attached to the sole. Footbed (84) includes a downwardly extending bar (92) sized for complementary sliding engagement in an aperture (94) formed through base (82). As shown in FIG. 1, the initial angular inclination of the upper surface of foot support surface (96) of footbed (84) is provided by a compression spring (98) positioned in cavity (99). The spring is interchangeably appropriate for the loading of the particular skier. For downhill skiing, foot support surface (96) is typically supported by compression spring (98) to incline downwardly from heel (88) towards toe (90) at an initial angle (100) relative to the lower surface (102) of sole (70). Angle (100) is commonly about 9°.

Figure 4:
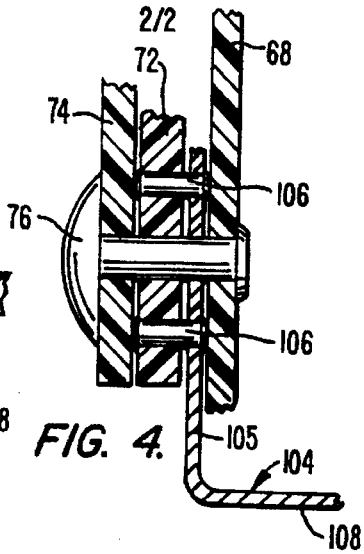
FIG. 4 is an enlarged sectional view showing the yoke connected to the front cuff.
Figure 3:
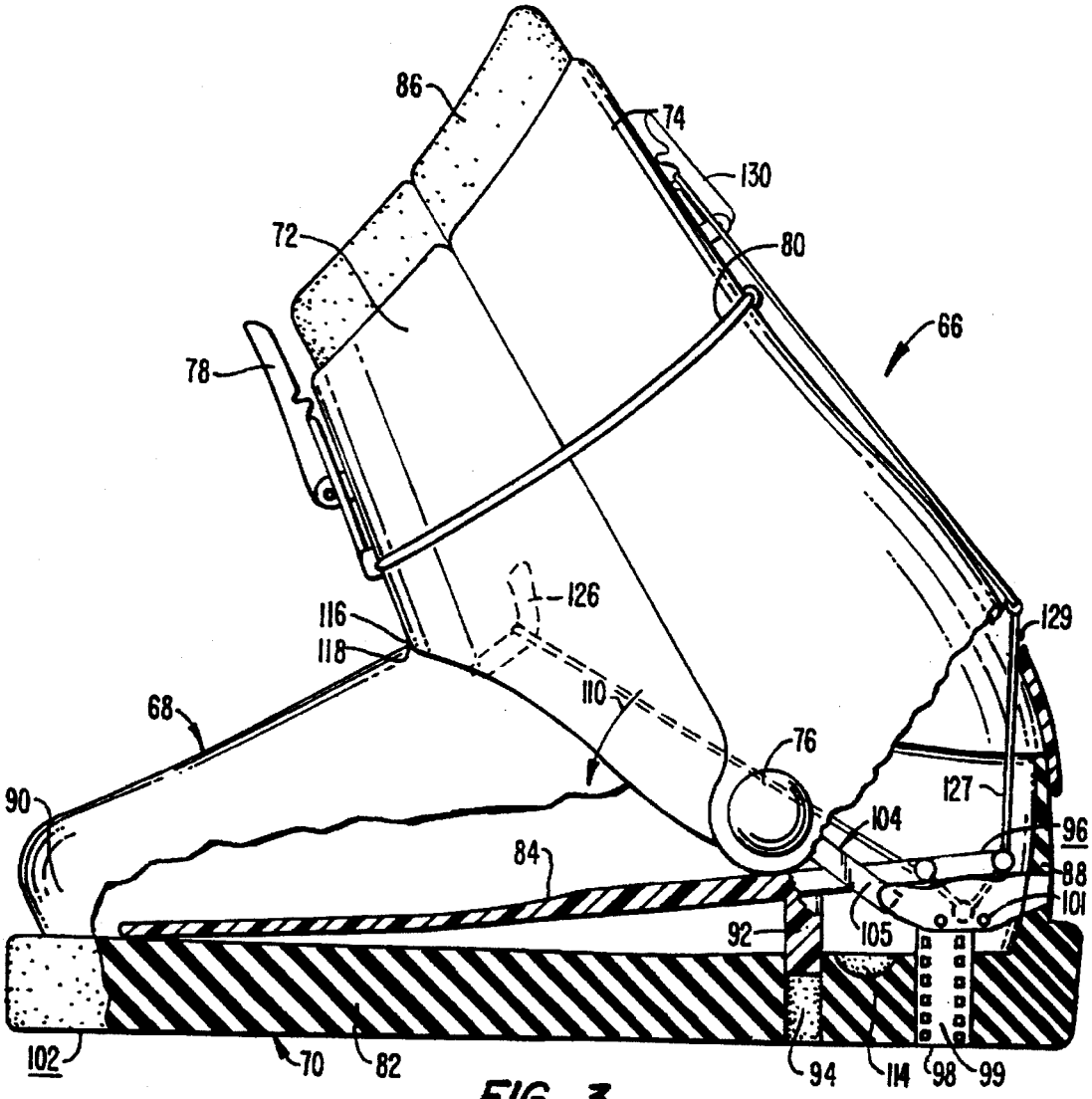
FIG. 3 shows the embodiment of FIG. 1 with the footbed raised and the cuff pivoted fully forward and the instep strap fully tightened.

A U-shaped yoke (104), shown in FIG. 4, is pivotally mounted at its upper arms (105) to pivots (76). (Yoke (104) acts as an upwardly extending limit member.) Arms (105) of yoke (104) are also adjustably fastened to front cuff (72) by press fit rivets (106) so that front cuff (72) and yoke (104) pivot together about pivots (76). The generally horizontal portion (108) of yoke (104) lies beneath footbed (84). Pivoting front cuff (72) forwardly in the direction of arrow (110) causes yoke (104) to pivot upwardly in the direction of arrow (112), thus lifting portion (108) from a recess (114) in base (82) of sole (70) to engage footbed (84). (Yoke (104) and footbed (84) act as means for limiting flexion of the leg relative to the foot (the cuff relative to the footbed) beyond a predetermined angle because at the point where lifting portion (108) of yoke (104) contacts footbed (84), further forward pivotal movement of front cuff (72) causes footbed (84) to be raised.) Continued forward movement of front cuff (72) causes yoke (104) to raise upper foot support surface (96). (Engagement of yoke (104) with footbed (84) to raise the footbed in response to this continued forward movement provides means for permitting further forward flexion by the leg relative to the sport shoe performing surface while substantially maintaining the predetermined angle.) The engagement of yoke (104) with footbed (84) to raise the footbed in response to this continued forward movement also, provides means for coupling the cuff to the footbed to permit further forward flexion of the leg relative to a sport shoe performing surface while substantially maintaining the predetermined angle. Forward movement of upwardly extending limit member cuff (72) is stopped when lower edge (116) contacts shell (68) at a point (118) as shown in FIG. 3. Rearward movement of upwardly extending limit member cuff (72) is stopped when lower edge (116) contacts the upward extension of shell (68) (not shown).

It should be noted that there are two separate angular orientations being considered. The first is the angular orientation between the user's foot and lower leg. Forward flexion of the user's leg from a position perpendicular to the user's foot, called dorsiflexion, is measured from a line perpendicular to foot support surface (96). These angles are illustrated in FIG. 1A. For alpine skiing an initial dorsiflexion of about 9° is presently considered most desirable. Since the upper supporting foot support surface (96) is inclined upwardly and rearwardly at about 9°, the user's leg is initially flexed about 18° forward from the horizontal, that is a line perpendicular to lower surface (102) on the upper surface of a ski. The lower leg angles relative to the horizontal are shown in FIG. 1B.

There is an instep strap (126) located in the interior of the shell which overlies the liner (86) and engages the upper surface of the skier's foot in the area of the instep. Instep strap (126) is relatively flexible and typically constructed of plastic or similar material. A cable (127) passes over and is attached to the instep strap (126) and is routed through cable guide loops (128) known per se on the footbed (84) and shell (68). The cable is also routed through a cable guide bore (129) located on each side of the rear cuff (74) to an adjustable dynamic fitting system overcenter buckle (130) located on the rear cuff (74).

In the use of ski boot (66), the appropriate compression spring (98) is located in cavity (99) in sole (70). As stated above, angle (100) is typically about 9°. This adjustment causes a 9° forward inclination of the user's leg with a zero dorsiflexion angle. The initial angle of the user's leg relative to ski lower surface (102) is indicated by angle (119) and is typically about 18°, reflecting the initial 9° angle of foot support surface (96) and the additional 9° angulation of cuffs (72), (74). The length of the arms (105) of yoke (104) is selected so that portion (108) of yoke (104) lies a predetermined distance below footbed (84) when the user's leg and foot are at an initial dorsiflexion angle (120), typically 9°. The relationships of the pivoting of the front cuff (72) and the pivoting of the footbed (84) is determined by the angle and length of the yoke (104), the particular compression spring (98), and the pivot point of the footbed (84). Thus additional dorsiflexion by the user can occur before portion (108) begins to lift footbed (84) and foot support surface (96). This angle has been empirically determined to be preferably about 3% so that a dorsiflexion angle of about 12° must occur before the forward flexion of the user's leg will begin to raise the footbed (84). This dorsiflexion angle of 12° is considered to be an optimum for downhill skiing and adjustments can be made to take into account individual preferences, skiing ability, etc. The optimum dorsiflexion angle is indicated in FIG. 1A as angle (121). Angle (121) results in a lower leg angle (123), with respect to the lower surface (102), of about 21°.

The skier steps into ski boot (66) and closes the adjustable cuff buckle (78) and adjustable dynamic fitting system overcenter buckle (130) to a close comfortable fit. The cuff buckle (78) and overcenter buckle (130) provide means for closing the shoe to a close comfortable fit. The footbed is operatively connected to the shell, cuffs and instep strap by the yoke and cable mechanism. As shown in FIGS. 3 and 4, during forward flexion of the cuff (72) and pivoting upward of footbed (84) by yoke (104), cable (127) which passes through cable guide loops (128) located on shell (68) and footbed (84) is relatively shortened due to the increased distance between the cable guide loops (128) on the shell (68) and raised heel portion of the footbed (84) increasing the tightness of the instep strap (126) on the liner and foot. (Instep strap (126), cable (127) and guide loops (128) provide means for tightening the shoe on the foot during further forward flexion of the leg relative to the sport shoe performing surface.) The cable is also relatively shortened and the instep strap (126) tightened during short excursion rearward flexion of cuff (74) which can occur for instance due to yielding of materials in completing certain turns, acceleration on a steep slope and in slalom racing. The increased loading of the compression spring (98) results in pivoting downward of the heel portion of the footbed (84), relatively shortening the cable (127) due to the increased distance between the cable guide loops (128) on the shell (68) and footbed (84) as shown in FIG. 3. Guides (101) are located on shell (68) to further increase the relative tightening of cable (127) in downward movement of footbed (84) from the neutral position. Thus, the optimum dorsiflexion angle is maintained.

The present invention allows the user to maintain an optimum dorsiflexion angle even while he or she increases his or her forward lower leg flex relative to the ski surface because yoke (104) increases the angularity of the movable footbed (84) in accordance with the increased forward angulation of cuffs (72), (74). In other words, a forward flexion beyond lower leg angle (123) results in no appreciable further increase in dorsiflexion. In practice it has been found that some further increase in dorsiflexion will usually occur due to the yielding of materials and the configuration of yoke (104). Therefore when optimum dorsiflexion is referred to in this application it is to be understood to include a relatively narrow range of dorsiflexion angles over which the athlete can perform at peak levels. FIG. 3 shows front cuff (72) in its forwardmost position when edge (116) contacts shell (68) at point (118). This position illustrates an additional pivotal movement of front cuff (72) of approximately 10° after foot support surface (96) begins to be lifted by yoke (104) and corresponds to a maximum lower leg angle (123) of about 31°. However, because of the upward movement of foot support surface (96) in the direction of arrow (112), the dorsiflexion angle has remained substantially constant.

Modification and variation can be made to the disclosed embodiments without departing from the subject of the invention as defined in the following claims.

I claim:

1. A sport shoe comprising:

a sole;

a shell extending from the sole;

means for closing the shoe to a close fit on a foot located in the shoe;

means for permitting flexion of a leg relative to the foot located in the shoe;

means for limiting flexion of the leg relative to the foot beyond a predetermined angle;

means for permitting further flexion of the leg relative to the sport shoe performing surface while substantially maintaining the predetermined angle; and means movable relative to said further flexion permitting means for tightening the shoe on the foot during said further flexion of the leg relative to said sport shoe performing surface.

2. A sport shoe according to claim 1 wherein said flexion limiting means includes an upwardly extending limit member.

3. A sport shoe according to claim 2 wherein said further flexion permitting means includes a footbed movable relative to said shoe.

4. A sport shoe according to claim 3 wherein:

said footbed is coupled to said limit member;

said limit member is movable relative to said shell; and said footbed is moved when said limit member is moved a predetermined angle.

5. A sport shoe according to claim 4 wherein said footbed increases the tightness of the fit of the shoe when said footbed is raised.

6. A sport shoe according to claim 4 wherein said footbed comprises a footbed heel portion which is raised when said limit member is moved beyond a predetermined angle.

7. A sport shoe according to claim 4 wherein said footbed is coupled to said limit member by a yoke.

8. A sport shoe according to claim 3 wherein:

said footbed is coupled to a spring member;

said spring member is movable relative to said shell;

and said footbed is lowered when said spring member is compressed.

9. A sport shoe according to claim 8 wherein said footbed heel portion is lowered when said spring member is compressed.

10. A sport shoe according to claim 3 wherein said footbed is coupled to said tightening means.

11. A sport shoe according to claim 10 wherein said tightening means increases the tightness of the fit of the shoe when said footbed is raised.

12. A sport shoe according to claim 10 wherein said tightening means increases the tightness of the fit of the shoe when said footbed is lowered.

13. A sport shoe according to claim 10 wherein said tightening means engages the upper surface of the foot.

14. A sport shoe according to claim 13 wherein said tightening means includes a cable and cable guide mechanism.

15. A sport shoe according to claim 13 wherein said tightening means includes an instep strap.

16. A sport shoe according to claim 15 wherein said performing surface includes a ski surface.

17. A sport shoe according to claim 15 wherein said footbed is coupled to said cuff by an adjustable yoke.

18. A ski boot comprising:

a relatively rigid sole;

a shell extending from the sole;

a cuff extending from the shell and movable relative to the shell;

the cuff being movable with respect to the shell to permit forward flexion of a leg relative to a foot located in the shoe;

a footbed located in the shoe;

means for limiting movement of the cuff relative to the footbed to limit forward flexion of the leg relative to the foot beyond a predetermined angle;

means for coupling the cuff to the footbed to permit further forward flexion of the leg relative to a sport shoe sport performing surface while substantially maintaining the predetermined angle; and means movably engaging the upper surface of the foot coupled to the footbed for tightening the shoe on the foot during said further forward flexion relative to the sport shoe performing surface.

* * * * *